US012209831B2

(12) United States Patent
Sun

(10) Patent No.: US 12,209,831 B2
(45) Date of Patent: Jan. 28, 2025

(54) AUTOMATIC CIRCULATION SHOOTING MECHANISM

(71) Applicant: Huai-Ku Sun, Taoyuan (TW)

(72) Inventor: Huai-Ku Sun, Taoyuan (TW)

( * ) Notice: Subject to any disclaimer, the term of this patent is extended or adjusted under 35 U.S.C. 154(b) by 0 days.

(21) Appl. No.: 18/319,667

(22) Filed: May 18, 2023

(65) Prior Publication Data

US 2024/0384953 A1 Nov. 21, 2024

(51) Int. Cl.

| | |
|---|---|
| ***F41A 5/16*** | (2006.01) |
| ***F41A 3/26*** | (2006.01) |
| ***F41A 3/88*** | (2006.01) |
| ***F41A 15/14*** | (2006.01) |

(52) U.S. Cl.

CPC *F41A 3/26* (2013.01); *F41A 3/88* (2013.01); *F41A 15/14* (2013.01)

(58) Field of Classification Search

CPC .... F41A 5/14; F41A 5/16; F41A 21/26; F41A 3/88; F41A 9/47

USPC ..... 89/160, 161, 162, 174, 178, 177

See application file for complete search history.

(56) References Cited

U.S. PATENT DOCUMENTS 663,955 A * 12/1900 Burgess ..... F41A 3/16 42/11
663,956 A * 12/1900 Burgess ..... F41A 3/16 89/154
802,279 A * 10/1905 Frommer ..... F41A 17/38 42/7
834,753 A * 10/1906 Reifgraber ..... F41A 3/38 89/159
918,380 A * 4/1909 Schwarzlose ..... F41A 5/16 89/178
958,545 A * 5/1910 Ross ..... F41A 17/38 89/187.01
988,996 A * 4/1911 Frommer ..... F41A 5/14 89/162
1,337,444 A * 4/1920 Douglas ..... F41A 19/27 89/151
1,469,918 A * 10/1923 De Maine ..... F41A 25/02 89/44.01

(Continued)

FOREIGN PATENT DOCUMENTS

CN 102062559 B 5/2013
CN 208936858 U 6/2019

(Continued)

*Primary Examiner* — Derrick R Morgan
(74) *Attorney, Agent, or Firm* — Rosenberg, Klein & Lee

(57) ABSTRACT

An automatic circulation shooting mechanism includes a gun body assembly, a gun barrel assembly, a bolt assembly, a recoil spring assembly, a triggering assembly, and a cartridge feeding assembly. Regarding the gun body assembly, a barrel fixing cap can separate from a barrel frame, so the gun barrel assembly mounted in the barrel frame can be replaced. The gun barrel assembly includes two barrel spring fixing seats disposed on a barrel, a barrel spring therebetween and a barrel extension. The barrel extension and a breech bolt of the bolt assembly are engaged for locking while shooting to allow the barrel and the breech bolt to recoil together by a linear freedom motion and affect the barrel spring, a bolt spring of the bolt assembly, and the recoil spring assembly for absorbing, storing, and releasing energy, thereby buffering recoil force of the shooting efficiently and attaining an automatic circulation shooting effect.

6 Claims, 2 Drawing Sheets

(56) References Cited

U.S. PATENT DOCUMENTS 2,389,960 A * 11/1945 Dobremysl ..... F41A 9/32 89/169
2,453,830 A * 11/1948 Chadwick ..... F41A 25/18 89/44.01
2,557,134 A * 10/1951 Mudespacher ..... F41A 25/10 89/42.03
2,628,536 A * 2/1953 Schaich ..... F41A 3/44 89/137
3,088,378 A * 5/1963 Boudreau ..... F41A 5/16 89/33.02
3,489,060 A 1/1970 Marocchi
3,736,839 A * 6/1973 Childers ..... F41A 19/39 89/193
3,985,062 A * 10/1976 Hupp ..... F41A 25/12 89/159
3,987,571 A * 10/1976 Orozco ..... F41A 3/54 42/71.01
4,022,105 A * 5/1977 White ..... F41A 19/31 89/181
4,028,994 A * 6/1977 Ferluga ..... F41A 5/16 89/161
4,061,075 A * 12/1977 Smith ..... F41A 15/00 42/25
4,677,897 A * 7/1987 Barrett ..... F41A 19/30 89/198
5,123,329 A * 6/1992 Irwin ..... F41A 9/47 89/14.3
5,827,991 A * 10/1998 Predazzer ..... F41A 5/16 89/178
5,974,941 A * 11/1999 Kushnir ..... F41A 9/28 89/33.03
8,418,389 B1 * 4/2013 Lukman ..... F41A 5/34 42/1.06
8,539,706 B1 * 9/2013 Vieweg ..... F41A 3/82 42/1.06
9,696,101 B2 * 7/2017 Kada ..... F41A 3/56
11,946,713 B2 * 4/2024 Puha ..... F41A 5/12
2006/0027091 A1 * 2/2006 Ratti ..... F41A 5/20 89/162
2010/0192439 A1 * 8/2010 Murello ..... F41A 25/10 42/1.06
2013/0192452 A1 * 8/2013 Plaxats Oller ..... F41A 15/18 89/161
2014/0173963 A1 * 6/2014 Kent ..... F41A 21/32 42/90
2015/0338178 A1 11/2015 Neitzling
2016/0290753 A1 * 10/2016 Sewell, Jr. ..... F41A 3/72

FOREIGN PATENT DOCUMENTS

TW I585359 B 6/2017
TW I703303 B 9/2020
WO 2009048668 A1 4/2009
WO 2019147723 A1 8/2019

* cited by examiner

AUTOMATIC CIRCULATION SHOOTING MECHANISM

BACKGROUND OF THE INVENTION

1. Field of the Invention

This invention relates to a shooting structure and relates particularly to an automatic circulation shooting mechanism.

2. Description of the Related Art

A gas operation is commonly adopted by a conventional automatic shooting mechanism, such as automatic rifles. The gas-operated reloading gun can be mainly categorized by a "direct air-impingement" such as M4 rifles and a "gas piston" such as AR18 rifles and AK47 rifles. Generally, the gas operation needs to introduce gunpowder gas from a barrel into a gas-operated device through a gas hole. However, carbon residue caused by gas of a propellant is easily adhered to the gun after the shooting operation because of incomplete combustion of the propellant. The carbon residue is corrosive. If the carbon residue is adhered to elements of the gun such as a gas introducing device, a barrel, and a bolt carrier, they may be corroded, blocked, or poorly operated. They may also have an unstable rate of fire.

Accordingly, these guns require frequent maintenance to keep their operating properties. Regarding the direct air-impingement or gas piston, it needs to add some rebound balance blocks in a recoil spring seat when a recoil spring pushes a bolt assembly and causes counter-recoil force whereby the bolt assembly locks with barrel, and this action prevents the bolt carrier from rebounding and locking incompletely. The direct air-impingement also needs to introduce gas to the bolt carrier to unlock, namely push open. This action accumulates carbon at the head of the bolt carrier easily, and the accumulation of carbon affects a locking action. Therefore, the common solution is to install a forward assist to assist the bolt carrier in locking completely in case the accumulation of carbon occurs.

In addition, a fixed barrel is adopted by most of conventional automatic rifles and is unable to be quickly replaced, so the tactical use may not be very flexible. Furthermore, the instant recoil caused by the pressure of the gunpowder gas of the gas-operated rifle is only absorbed by a recoil spring, and the gas force of the gas operation and the recoil of the gas pressure in the barrel are usually formed along different axes. These physical conditions usually cause larger vibration of shooting recoil.

A Patent No. I585359 published in Taiwan discloses a continuous firing and shooting cycle mechanism of a barrel-recoil type automatic weapon. This disclosure omits the conventional gas-operated mechanism and uses a barrel short recoil and inertia driven technique for the automatic transmission of the weapon system. However, this disclosure is only adapted to an open bolt system because the trigger unit and the shooting mode are simpler and configured to provide easy control modes, such as semi-fire, burst-fire, and insurance. The disclosed system is not suitable for a complex and closed shooting control for automatic rifles, the customary mode of which is mainly categorized by semi-fire, two-round or three-round fire, burst-fire, and insurance. In short, the conventional disclosure is not adapted to the current trigger mechanism in the lower receiver of most automatic rifles.

SUMMARY OF THE INVENTION

An object of this invention is to provide an automatic circulation shooting mechanism capable of replacing a gun barrel assembly quickly.

Another object of this invention is to provide an automatic circulation shooting mechanism capable of preventing the force of shocking back and rebounding from impinging on a bolt assembly which is in a locking state and also capable of buffering the instant recoil caused by firing and shooting cartridges, thereby increasing the benefit of the automatic circulation shooting operation efficiently.

According to this invention, an automatic circulation shooting mechanism includes a gun body assembly, a gun barrel assembly, a bolt assembly, a recoil spring assembly, a triggering assembly, and a cartridge feeding assembly. The gun body assembly includes an upper receiver, a lower receiver connected to the upper receiver, a bolt carrier stopper disposed in the upper receiver, a barrel frame connected to the upper receiver, and a barrel fixing cap in opposing relationship to the upper receiver and configured to be detachably engaged with an end of the barrel frame. The gun barrel assembly includes a barrel mounted in the barrel frame, a barrel extension disposed on the barrel and in proximity to the upper receiver, a first barrel spring fixing seat disposed on the barrel, a second barrel spring fixing seat disposed on the barrel and spaced apart from the first barrel spring fixing seat, and a barrel spring annularly disposed around the barrel. One end of the barrel spring is connected to the first barrel spring fixing seat, and another end thereof is connected to the second barrel spring fixing seat. The first barrel spring fixing seat is covered by the barrel fixing cap so that the barrel is partially inserted into the barrel frame. A rotation of the barrel fixing cap separates the barrel fixing cap from the barrel frame to allow the gun barrel assembly to be detached from the barrel frame. The barrel spring possesses elasticity whereby the barrel is inserted into the barrel frame, moved by recoil force, and rebounded to its original position automatically. The bolt assembly includes a bolt carrier disposed in the upper receiver, a breech bolt mounted in the bolt carrier and located in correspondence with the barrel extension, a firing pin disposed in the breech bolt and located in correspondence with the barrel, and a bolt spring disposed between the bolt carrier and the breech bolt. The bolt carrier includes a cam slot formed thereon and an engagement portion adapted to butt against the bolt carrier stopper. A cam pin is disposed on the breech bolt and inserted into the cam slot. By the cooperation between the cam pin and the cam slot, a locking action and an unlocking action between the breech bolt and the barrel extension can be executed. The recoil spring assembly includes a recoil spring seat propping against the bolt carrier and a recoil spring annularly disposed around the recoil spring seat. The triggering assembly includes a trigger disposed outside of the lower receiver and a hammer associated with the trigger and configured to strike the firing pin of the bolt assembly. The cartridge feeding assembly includes a magazine placed in correspondence with the bolt assembly and a plurality of cartridges mounted in the magazine. The cartridges are pushed by the breech bolt of the bolt assembly in sequence and then fed into the barrel for subjecting each cartridge to a firing and shooting operation.

In accordance with the above arrangement, the barrel extension assists the barrel in engaging with the breech bolt to perform a locking state. When the firing pin struck by the trigger assembly hits a primer of a cartridge loaded in the barrel to ignite a propellant substance, high pressure gas generated by igniting the propellant substance causes a projectile of the cartridge to shoot forwards quickly. Because the barrel extension and the breech bolt are locked with each other, the barrel and the breech bolt recoil together by a linear freedom motion under the gas pressure of the propellant substance, and then the barrel spring is compressed to store and thence release energy for returning the barrel to its original position. Concurrently, the bolt spring of the bolt assembly receives compressed energy for absorbing and storing energy. Thereafter, the bolt spring releases the energy to push the bolt carrier so that the bolt carrier receives the energy and then compresses the recoil spring assembly to move backwards, and this movement also allows the breech bolt to unlock simultaneously and subjects a cartridge case of the cartridge to an ejecting action. After the recoil spring assembly consumes recoil force added to the recoil spring assembly, the bolt assembly returns to its original position and also completes a motion of pushing a new cartridge and a motion of feeding the pushed cartridge for loading. When the bolt carrier returns to its original position, the engagement portion butts against the bolt carrier stopper so that the shock back and rebound force which the breech bolt suffers can be reduced while locking the breech bolt with the barrel extension by rotation.

It is also noted that the barrel fixing cap and the barrel frame are detachably connected to each other. Specifically, when the barrel fixing cap is firmly engaged with the barrel frame, preferably in a rotating manner, the gun barrel assembly can be stably positioned in the barrel frame. When the barrel fixing cap separates from the barrel frame, the gun barrel assembly can be quickly replaced.

From above, the tactical use of this invention, especially in the shooting use, can be more flexible, and the benefit of the automatic circulation shooting operation can be efficiently increased.

Preferably, the barrel frame includes a stop portion formed thereon. The second barrel spring fixing seat is configured to abut against the stop portion while mounting the barrel in the barrel frame, and concurrently the first barrel spring fixing seat is configured to abut against the barrel fixing cap.

Preferably, a sleeve engagement member can be formed at one end of the barrel extension, and a bolt locking member can be formed at one end of the breech bolt and adapted to engage with or separate from the sleeve engagement member.

Preferably, an extractor and an ejector can be respectively disposed on the breech bolt. The extractor serves to extract a cartridge case of a cartridge from the barrel after the cartridge is subjected to the firing and shooting operation, and the ejector serves to eject the extracted cartridge case from the gun body assembly.

DETAILED DESCRIPTION OF THE PREFERRED EMBODIMENTS

Figure 1:
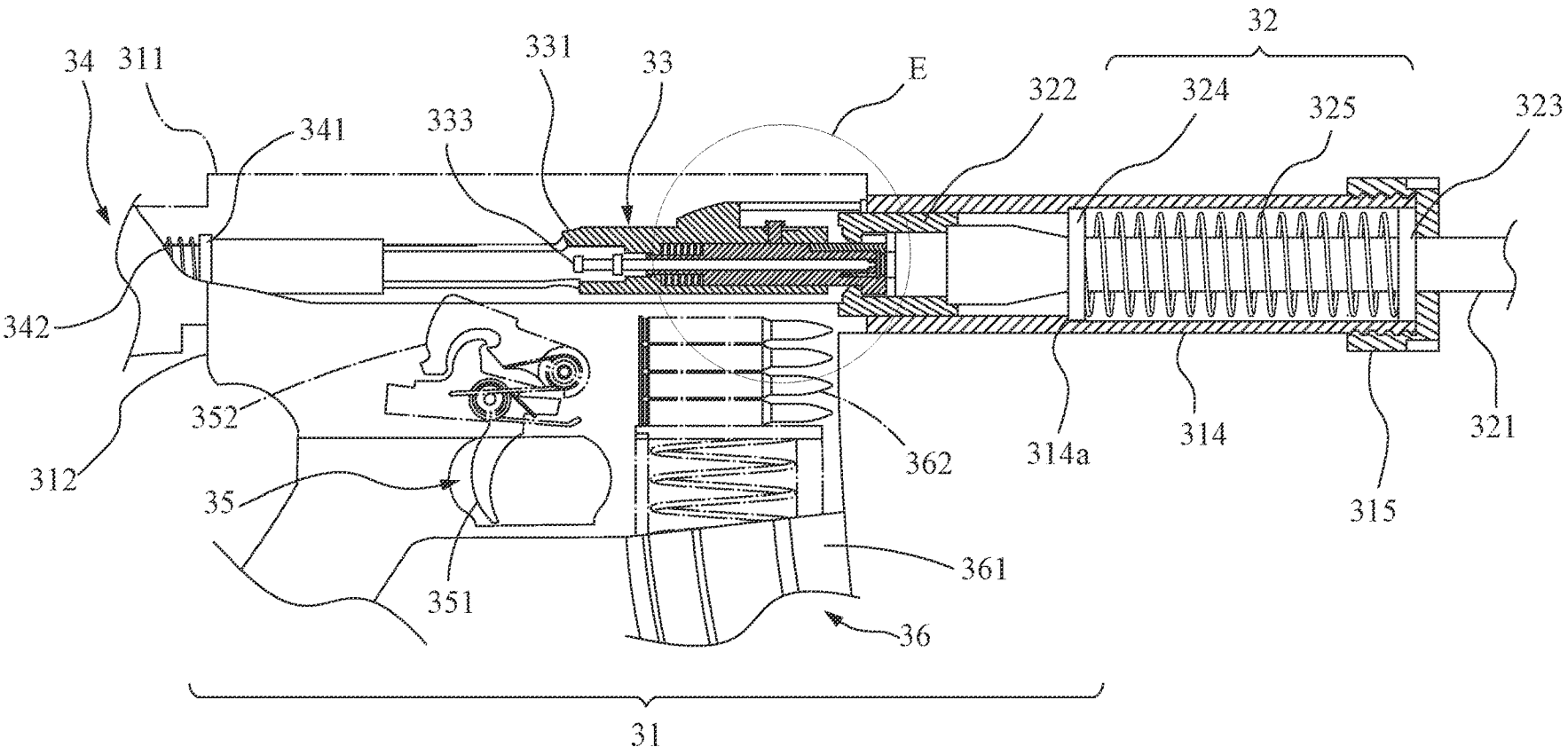
FIG. 1 is a schematic view showing a first preferred embodiment of this invention.
Figure 2:
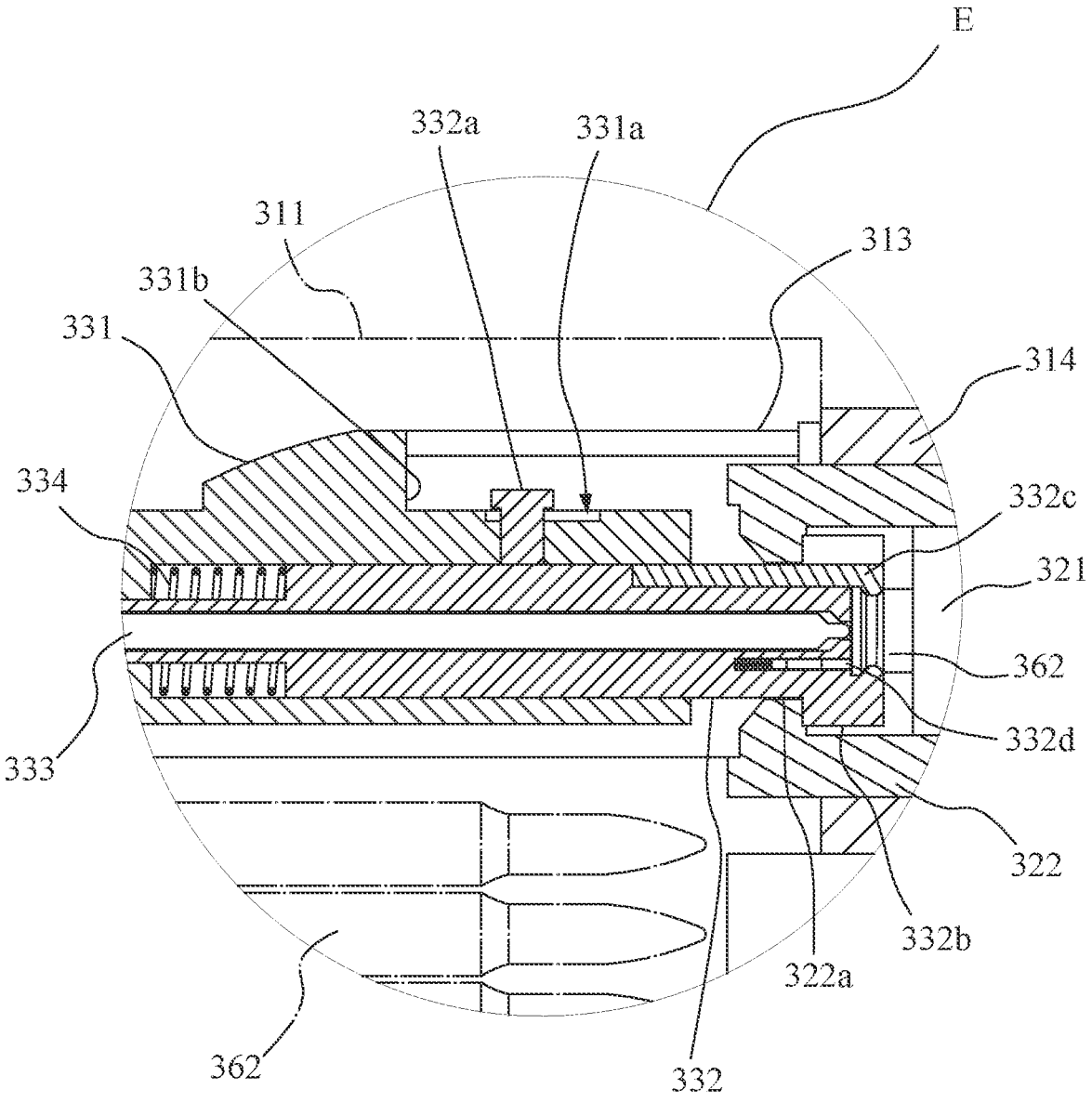
FIG. 2 is an enlarged view of an encircled portion "E" of FIG. 1.

Referring to FIGS. 1 and 2, a first preferred embodiment of an automatic circulation shooting mechanism 3 is briefly shown. Herein, the term "circulation" is mainly used to express the cycle or a repeated sequence of actions for the operation of the shooting mechanism 3. The shooting mechanism 3 includes a gun body assembly 31, a gun barrel assembly 32, a bolt assembly 33, a recoil spring assembly 34, a triggering assembly 35, and a cartridge feeding assembly 36. These assemblies 32~36 are respectively connected to the gun body assembly 31. Regarding the gun body assembly 31, the gun body assembly 31 includes an upper receiver 311, a lower receiver 312 connected to the upper receiver 311, a bolt carrier stopper 313 disposed in the upper receiver 311, a barrel frame 314 connected to the upper receiver 311, and a barrel fixing cap 315 opposite to the upper receiver 311. The barrel fixing cap 315 is in opposing relationship to the upper receiver 311 for being engaged with an end of the barrel frame 314. The upper receiver 311 is configured to accommodate or receive the bolt assembly 33 so that the bolt assembly 33 is allowed to execute a rail-mounted reciprocating motion. The lower receiver 312 is configured to accommodate or receive the triggering assembly 35 and the cartridge feeding assembly 36 for controlling a firing and shooting operation of the shooting mechanism 3.

A stop portion 314*a* is formed on an interior of the barrel frame 314, and the gun barrel assembly 32 abuts against the stop portion 314*a* so that the gun barrel assembly is positioned, which allows the gun barrel assembly 32 to execute a linear reciprocating movement inside the barrel frame 314. A portion of the gun barrel assembly 32 is disposed outside of the barrel fixing cap 315, which causes the gun barrel assembly 32 to be partially inserted into the barrel frame 314. A rotation of the barrel fixing cap 315 can be driven by a tool, such as a spanner (not shown). When the barrel fixing cap 315 is engaged with the barrel frame 314 by rotating with the tool in one direction, the gun barrel assembly 32 can be positioned inside the barrel frame 314. On the contrary, when the barrel fixing cap 315 is disengaged with the barrel frame 314 by rotating in the other direction, the gun barrel assembly 32 can be detached from the barrel frame 314, and a new gun barrel assembly 32 can be inserted into the barrel frame 314 and positioned. Therefore, a quick replacement of the gun barrel assembly 32 is achieved, and the replacement depends on different shooting needs. The gun barrel assembly 32 includes a barrel 321 mounted in the barrel frame 314, a barrel extension 322 disposed on the barrel 321 and in proximity to the upper receiver 311, a first barrel spring fixing seat 323 disposed on the barrel 321, a second barrel spring fixing seat 324 disposed on the barrel 321 and spaced apart from the first barrel spring fixing seat 323, and a barrel spring 325 annularly disposed around the barrel 321 and between the first barrel spring fixing seat 323 and the second barrel spring fixing seat 324. The barrel 321 is configured to fire and shoot ammunition, bear high chamber pressure, and allow a bullet, as a projectile of a cartridge, to fly forwards in a rotating manner. A sleeve engagement member 322*a*, briefly shown, is formed at one end of the barrel extension 322 and adapted to lock with or unlock with the bolt assembly 33. The first barrel spring fixing seat 323 can be fixed to the barrel 321, while the second barrel spring fixing seat 324 can be movably pivoted to the barrel 321. The second barrel spring fixing seat 324 is configured to abut against the stop portion 314*a* of the barrel frame 314 while mounting the barrel 321 in the barrel frame 314, and the first barrel spring fixing seat 323 is configured to abut against the barrel fixing cap 315 and covered by the barrel fixing cap 315. In addition, one end of the barrel spring 325 is connected to the first barrel spring fixing seat 323, and the other end of the barrel spring 325 is connected to the second barrel spring fixing seat 324. In this regard, the barrel 321 is able to move backwards by recoil force in the barrel frame 314 and is allowed to rebound, attain a counter-recoil effect, and return to its original position automatically by the elasticity of the barrel spring 325. Accordingly, the gun barrel assembly 32 can be modularized to meet demand.

The bolt assembly 33 is disposed in the upper receiver 311 and located on one side of the gun barrel assembly 32. The bolt assembly 33 includes a bolt carrier 331 disposed in the upper receiver 311, a breech bolt 332 mounted in the bolt carrier 331 and located in correspondence with the barrel extension 322 for carrying out a locking action and an unlocking action, a firing pin 333 disposed in the breech bolt 332 and located in correspondence with the barrel 321, and a bolt spring 334 disposed between the bolt carrier 331 and the breech bolt 332. In addition, the bolt carrier 331 includes a cam slot 331*a* formed thereon and an engagement portion 331*b* formed relative to the bolt carrier stopper 313 so that the engagement portion 331*b* is adapted to butt against the bolt carrier stopper 313. A forward movement of the bolt carrier 331 allows the engagement portion 331*b* to butt against the bolt carrier stopper 313 located in the upper receiver 311, thereby reducing the vibration, the shock back and rebound force, impinging on the breech bolt 332 which moves forwards for locking after the recoil occurs. As for example shown in figures, the location of the breech bolt 332 is related to the location of the barrel extension 322, and the location of the firing pint 333 is related to the location of the barrel 321. A cam pin 332*a* is disposed on the breech bolt 332 and adapted to be inserted into the cam slot 331*a* of the bolt carrier 331. A bolt locking member 332*b*, briefly shown, is formed at one end of the breech bolt 332 and located relative to the barrel extension 332 for serving to engage with or separate from the sleeve engagement member 322*a* of the barrel extension 322. An extractor 332*c* and an ejector 332*d*, briefly shown, can be disposed on different sides of the breech bolt 332. Accordingly, a locking action and an unlocking action between the breech bolt 332 and the barrel extension 322 disposed on the barrel 321 in a rotating manner can be executed because of the cooperation between the cam pin 332*a* and the cam slot 331*a*, and when the bolt carrier 331 recoils, the extractor 332*c* on the breech bolt 332 serves to extract a cartridge case left in the barrel 321, and thereafter the ejector 332*d* serves to eject the extracted cartridge case.

The recoil spring assembly 34 is disposed on one side of the bolt assembly 33. The recoil spring assembly 34 includes a recoil spring seat 341 propping against the bolt carrier 331 and a recoil spring 342 annularly disposed around the recoil spring seat 341.

By the elasticity of the recoil spring 342, the compression and the effect of absorbing and storing energy can be achieved, thereby buffering the recoil of the bolt carrier 331 and then pushing the bolt carrier 331 forwards.

The triggering assembly 35 is adapted to cooperate with the bolt assembly 33. The triggering assembly 35 includes a trigger 351 disposed outside of the lower receiver 312 and a hammer 352 associated with the trigger 351 and configured to strike the firing pin 333 of the bolt assembly 33. Specifically, the trigger 351 sticks out from the lower receiver 312 for being exposed to the outside and accordingly pulled by a shooter, and the hammer 352 linked to the trigger 351 is actuated by the trigger 351 to strike a rear end of the firing pin 333 located out of the breech bolt 332, which causes a front end of the firing pin 333 inside the breech bolt 332 to be inserted towards the barrel 321, and this insertion hits a primer at the bottom of a cartridge loaded in the barrel 321 for further firing and shooting.

The cartridge feeding assembly 36 includes a magazine 361 in relation to the bolt assembly 33 and a plurality of cartridges 362 mounted in the magazine 361. As for example shown in figures, the location of the magazine 361 can be related to the location of the bolt assembly 33, especially related to the breech bolt 332. The cartridges 362 are sequentially pushed by the bolt locking member 332*b* of the breech bolt 332 to complete a cartridge-pushing action and then fed into the barrel 321 for loading to complete a cartridge-feeding action. Therefore, the cartridges 362 are pushed from a top lip (not shown) of the magazine 361 and sent into a chamber of the barrel 321 in sequence, thereby subjecting each cartridge 362 to a firing and shooting operation actuated by the bolt assembly 33.

The operation of this invention is described with the aid of FIGS. 1 and 2. To subject a loaded cartridge 362, on the right side of FIG. 2 and already inside the barrel 321, to a firing and shooting operation, a shooter pulls the trigger 351 to release the hammer 352, and the released hammer 352 hits forwards to strike a rear end of the firing pin 333 of the bolt assembly 33. By this hitting action, a front end of the firing pin 333 sticks out from the breech bolt 332 to strike a primer at the bottom of the cartridge 362, and the primer explodes by the striking force to ignite a propellant substance stored inside the cartridge 362. The ignition of the propellant substance generates high pressure gas immediately, and a projectile of the cartridge 362 is pushed by the gas, thereby shooting the projectile forwards in a rotating motion and also pushing the breech bolt 332 backwards. Because there is a locking relationship between the barrel 321 and the breech bolt 332, the barrel 321 is allowed to recoil with the breech bolt 332 within the barrel frame 314 by a linear freedom motion at the moment of the backward movement caused by the high pressure gas. Meanwhile, the barrel spring 325 is compressed to store energy which is ready to return the barrel 321 to its original position. The bolt carrier 331 still remains in an original place at the time of shooting because of its own mass inertia and support force of the recoil spring assembly 34. In the meantime, the bolt spring 334 between the bolt carrier 331 and the breech bolt 332 is squeezed by the recoil of the linear freedom motion of the breech bolt 332 to bear and consume the recoil force of the barrel 321 and also store energy.

Then, after the barrel 321 moves backwards to the greatest extent, the barrel 321 returns to its original position because of the rebounding of the barrel spring 325. Meanwhile, the bolt spring 334 also rebounds after it is fully compressed, thereby releasing the stored energy and allowing the energy to push the bolt carrier 331 and move the recoil spring assembly 34 backwards by compression. During this pushing and backward movement, the hammer 352 is pressed downwards to an original position kept on standby, and concurrently the cam pin 332*a* disposed on the breech bolt 332 starts to rotate within the cam slot 331*a* of the bolt carrier 331 while the backward movement of the bolt carrier 331 occurs. After the cam pin 332*a* rotates by a certain angle, the bolt locking member 332*b* is disengaged with the sleeve engagement member 322*a* to complete an unlocking action whereby the bolt carrier 331 and the breech bolt 332 move backwards together to make the breech bolt 332 leave the barrel 321, and concurrently the extractor 332*c* disposed on the breech bolt 332 catches a cartridge case of the cartridge 362, left in the barrel 321 after being subjected to the firing and shooting operation, and extracts the cartridge case from the barrel 321, thereby fulfilling an extracting action.

After the cartridge case leaves the barrel extension 322, the ejector 332*d* disposed on the breech bolt 332 ejects the cartridge case from the gun body assembly 31 to fulfill an ejecting action. In addition, after the recoil spring seat 341, subjected to the pushing force of the bolt carrier 331 for moving the recoil spring 342 backwards by compressing, reaches a bottom of the lower receiver 312, an effect of "recoiling in place" for the automatic circulation is achieved. Thereafter, the recoil spring 342 rebounds to release the energy so that the recoil spring seat 341 is pushed to keep moving the bolt assembly 33 forwards. During the forward movement, the bolt locking member 332*b* of the breech bolt 332 pushes a new cartridge 362 from the magazine 361 and then feeds the new cartridge 361 into the barrel 321, namely into a chamber, thereby fulfilling a cartridge-pushing action and a cartridge-feeding action for the automatic circulation. Then, when the engagement portion 331*b* of the bolt carrier 331 meets the bolt carrier stopper 313, the breech bolt 332 butts against a rear end of the barrel 321 in the state of the forward movement of the bolt carrier 331 and causes the bolt locking member 332*b* to be engaged with the sleeve locking portion 322*a*. By an incessant squeezing force of the bolt carrier 331 caused by the forward movement, the cam pin 332*a* disposed on the breech bolt 332 is limited by the cam slot 331*a*, and this limitation makes the breech bolt 332 rotate so that the breech bolt 332 can be locked with the barrel extension 322 at the time of squeezing to fulfill a locking action, and a new firing and shooting operation can be automatically executed. Therefore, the operation of the mechanism 3 is automatically cycled to thereby attain an automatic circulation shooting effect.

To replace the gun barrel assembly 32 after finishing all firing and shooting operations, a tool (not shown) can be used to hold the barrel fixing cap 315 and impart torque whereby the barrel fixing cap 315 rotates and then separates from the barrel frame 314 under the rotation. Accordingly, an old gun barrel assembly 32 can be detached from the barrel frame 314, and then a new gun barrel assembly 32 can be inserted into the barrel frame 314 and positioned. After the replacement is done, the barrel fixing cap 315 can be engaged with the end of the barrel frame 314 with the tool again. Therefore, the gun barrel assembly 32 is quickly replaced, which allows a more flexible use and increases the benefit of the automatic circulation shooting operation.

The advantages of this invention are described as follows:

1. This invention includes a complex transmission mode involving the recoil of the barrel and the inertia drive system and takes advantage of the barrel frame 314 to transmit the recoil of the barrel and keep the gas of the ammunition inside the barrel 321 without spreading gas to other elements at the shooting stage, which facilitates an easy maintenance after the shooting stage and alleviates the burden on the maintenance.

2. This invention omits a conventional gas-operated device, a forward assist, and rebound balance blocks, so fewer transmission elements are needed to greatly reduce the whole weight of the mechanism and alleviate the burden in the long term of operation.

3. The engagement and disengagement between the barrel frame 314 and the barrel fixing cap 315 allows the quick replacement of different gun barrel assemblies with different barrel calibers and lengths. Therefore, the problem of failure to replace barrels of conventional automatic rifles can be solved, and the use of this invention can be more flexible.

4. The arrangement of this invention is adapted to a complex and closed shooting control mode, so this invention can be applied to the current trigger mechanism in the lower receiver of most automatic rifles. Therefore, the problem of failure to apply the shooting system to a complex aforementioned conventional triggering mechanism can be solved.

To sum up, this invention takes advantage of the barrel fixing cap to be detached from the barrel frame so that the gun barrel assembly can be quickly replaced. Furthermore, this invention takes advantage of the gun barrel assembly which includes the first barrel spring fixing seat, the second barrel spring fixing seat, and the barrel spring to allow the barrel and the breech bolt to recoil together by a linear freedom motion in the state of locking the barrel extension with the breech bolt while shooting and also subject the barrel spring, the bolt spring, and the recoil spring assembly to compression for absorbing and storing energy, thereby allowing the bolt carrier and the breech bolt to fulfill a rotary unlocking action and an ejecting action, compressing the recoil spring assembly to the greatest extent efficiently, and buffering the suffered recoil force. The barrel spring also releases energy to return the barrel to its original position. The rebounding of the recoil spring assembly also completes a cartridge-pushing action and a cartridge-feeding action for cartridges while returning the gun barrel assembly to its original position, and the engagement portion of the bolt carrier is formed to butt against the bolt carrier stopper of the gun body assembly, which allows the breech bolt to lock with the barrel extension again in a rotating manner to reduce rebound and vibration impinging on the breech bolt and also increasing the benefit of the automatic circulation shooting operation.

While the embodiments are shown and described above, it is understood that further variations and modifications may be made without departing from the scope of this invention.

What is claimed is:

1. An automatic circulation shooting mechanism comprising:

a gun body assembly including an upper receiver, a lower receiver connected to said upper receiver, a bolt carrier stopper disposed in said upper receiver, a barrel frame connected to said upper receiver, and a barrel fixing cap in opposing relationship to said upper receiver and configured to be detachably engaged with an end of said barrel frame;

a gun barrel assembly including a barrel movably inserted into said barrel frame, a barrel extension disposed on said barrel and in proximity to said upper receiver, a first barrel spring fixing seat disposed on said barrel, a second barrel spring fixing seat disposed on said barrel and spaced apart from said first barrel spring fixing seat, and a barrel spring annularly disposed around said barrel and located in said barrel frame, with one end of said barrel spring connected to said first barrel spring fixing seat, and another end of said barrel spring connected to said second barrel spring fixing seat, said first barrel spring fixing seat being covered by said barrel fixing cap, and an original position of said barrel being defined when said barrel is partially mounted in said barrel frame, a rotation of said barrel fixing cap separating said barrel fixing cap from said barrel frame to allow said gun barrel assembly to be detached from said barrel frame, said barrel spring possessing an elasticity whereby said barrel being moved to a backward position by recoil force caused by a firing and shooting operation, said barrel spring possessing an elasticity so that said barrel spring is compressed by the movement of said barrel, said barrel returning from said backward position to its said original position when said barrel spring rebounds under the elasticity of said barrel spring;

a bolt assembly disposed in said upper receiver and located on one side of said gun barrel assembly, said bolt assembly including a bolt carrier disposed in said upper receiver, a breech bolt mounted in said bolt carrier and located in correspondence with said barrel extension, a firing pin disposed in said breech bolt and located in correspondence with said barrel, and a bolt spring disposed between said bolt carrier and said breech bolt, wherein a cam slot is formed on said bolt carrier, and said bolt carrier includes an engagement portion adapted to butt against said bolt carrier stopper, a cam pin being disposed on said breech bolt and inserted into said cam slot, a locking action and an unlocking action between said breech bolt and said barrel being executed by a cooperation between said cam pin and said cam slot;

a recoil spring assembly disposed on one side of said bolt assembly, said recoil spring assembly including a recoil spring seat propping against said bolt carrier and a recoil spring annularly disposed around said recoil spring seat and serving to buffer said recoil force impacting on said bolt carrier and push said bolt carrier forwards by an elasticity of said recoil spring;

a triggering assembly including a trigger disposed outside of said lower receiver and a hammer associated with said trigger and configured to strike said firing pin of said bolt assembly; and a cartridge feeding assembly including a magazine and a plurality of cartridges mounted in said magazine, said magazine being located in correspondence with said bolt assembly, and said plurality of cartridges being pushed by said breech bolt of said bolt assembly in sequence and then fed into said barrel, firing and shooting each said cartridge.

2. The mechanism according to claim 1, wherein a stop portion is formed on an interior of said barrel frame, said second barrel spring fixing seat being configured to abut against said stop portion while mounting said barrel in said barrel frame, with said first barrel spring fixing seat configured to abut against said barrel fixing cap.

3. The mechanism according to claim 1, wherein a sleeve engagement member is formed at one end of said barrel extension, a bolt locking member being formed at one end of said breech bolt and serving to engage with or separate from said sleeve engagement member.

4. The mechanism according to claim 2, wherein a sleeve engagement member is formed at one end of said barrel extension, a bolt locking member being formed at one end of said breech bolt and serving to engage with or separate from said sleeve engagement member.

5. The mechanism according to claim 1, further comprising an extractor and an ejector respectively disposed on said breech bolt, said extractor serving to extract a cartridge case of each said cartridge from said barrel after said firing and shooting operation is done, said ejector serving to eject said cartridge case extracted by said extractor from said gun body assembly.

6. The mechanism according to claim 2, further comprising an extractor and an ejector respectively disposed on said breech bolt, said extractor serving to extract a cartridge case of each said cartridge from said barrel after said firing and shooting operation is done, said ejector serving to eject said cartridge case extracted by said extractor from said gun body assembly.

* * * * *